United States Patent [19]

Spialter

[11] Patent Number: 5,070,647

[45] Date of Patent: Dec. 10, 1991

[54] ADJUSTABLE GUARD ASSEMBLY WITH RESILIENT RELEASE MECHANISM

[76] Inventor: Millard L. Spialter, 1888 Arbor Ln., Union, N.J. 07083

[21] Appl. No.: 687,824

[22] Filed: Apr. 19, 1991

[51] Int. Cl.[5] ..... E06B 3/68

[52] U.S. Cl. ..... 49/55; 49/57; 49/141

[58] Field of Search ..... 49/55, 57, 141, 61

[56] References Cited

U.S. PATENT DOCUMENTS

| | | | |
|---|---|---|---|
| 1,481,615 | 1/1924 | Meyer | 49/55 X |
| 1,615,580 | 1/1927 | Hamel | 49/55 X |
| 1,662,167 | 3/1928 | Rexinger | 49/55 X |
| 2,303,718 | 12/1942 | Becker et al. | 49/57 |
| 3,425,165 | 2/1969 | Cleveland | 49/55 X |
| 4,437,265 | 3/1984 | Turro et al. | 49/57 |
| 4,671,012 | 6/1987 | Merklinger et al. | 49/55 |
| 4,679,351 | 7/1987 | Zarlengo et al. | 49/57 |
| 4,685,247 | 8/1987 | Alam | 49/55 |
| 4,787,174 | 11/1988 | Brown | 49/55 |
| 4,899,490 | 2/1990 | Jokel | 49/55 |

FOREIGN PATENT DOCUMENTS

| | | | |
|---|---|---|---|
| 212089 | 5/1957 | Australia | 49/55 |

*Primary Examiner*—Philip C. Kannan

*Attorney, Agent, or Firm*—Lerner, David, Littenberg, Krumholz & Mentlik

[57] ABSTRACT

An adjustable guard assembly constructed to permit quick removability when positioned in an enclosure, has a first and second section, each section including at least one transverse member, a plurality of longitudinally extending members which are secured at one respectively end to an associated one of the transverse member. The two sections are mounted for relative axial movement with respect to each other so as to vary the width of the guard assembly and can be fixed at a given width by a resilient release mechanism which is operatively associated with the first section and the second section. The resilient release mechanism can be adjusted to provide a predetermined force necessary for maintaining the sections in their desired longitudinal position and to permit quick removal of the guard assembly from its assembled position in the enclosure when the predetermined force is overcome by any suitable means exerted against the guard assembly in an emergency situation.

17 Claims, 8 Drawing Sheets

FIG. 1
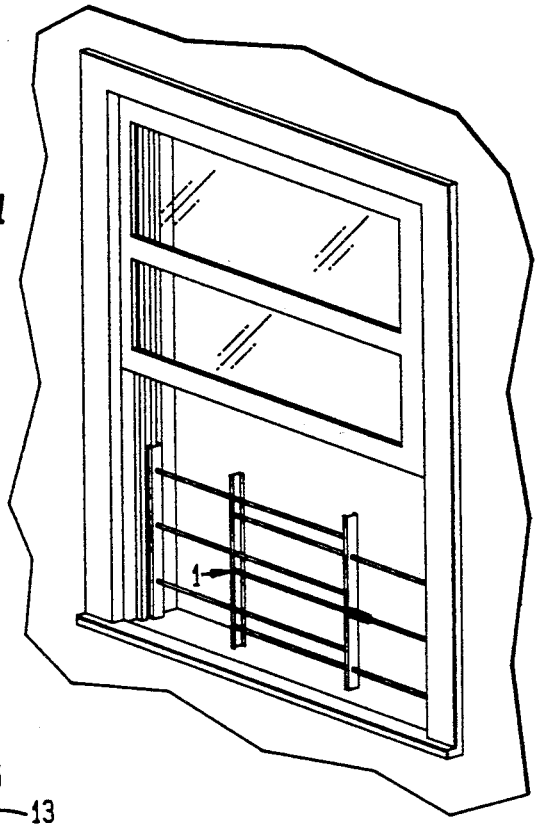
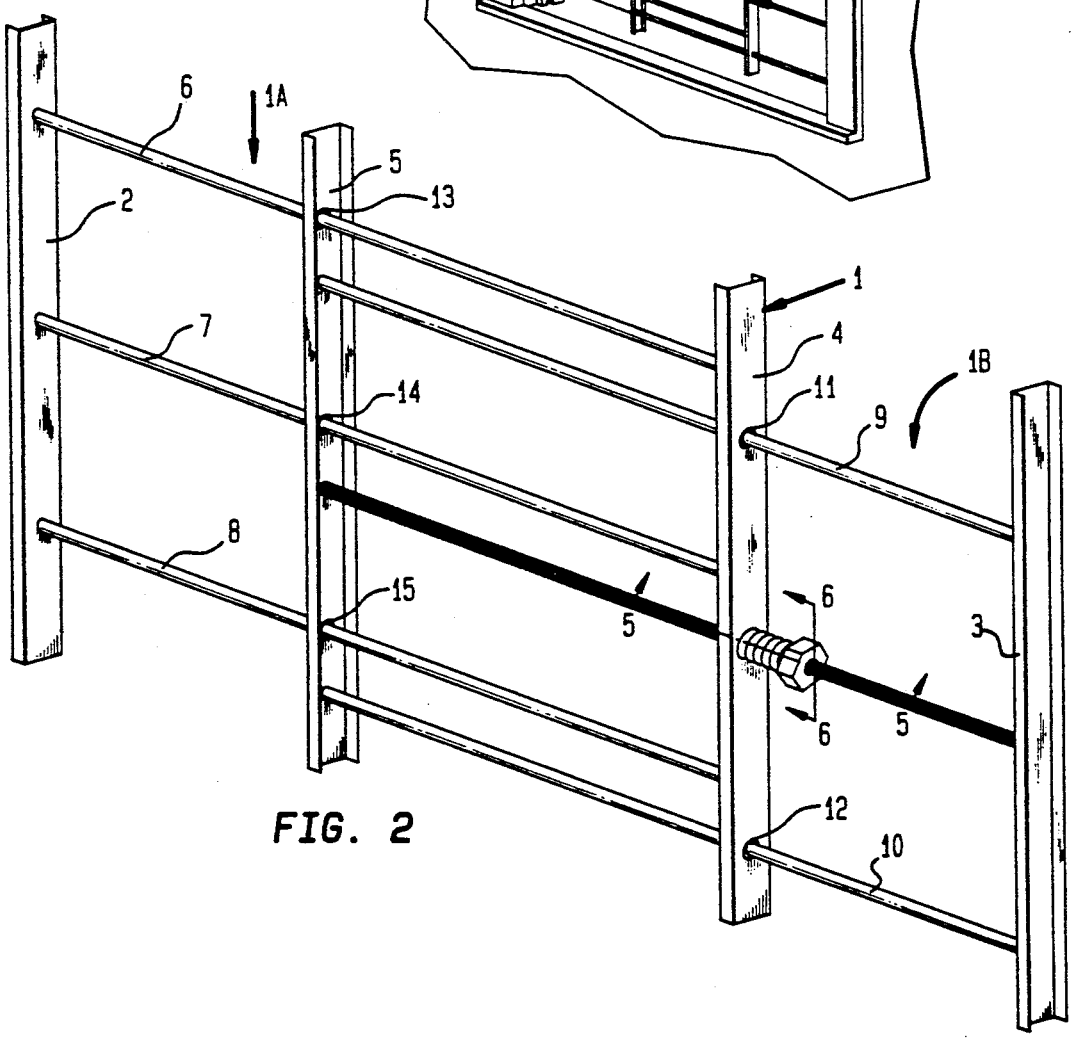
FIG. 2

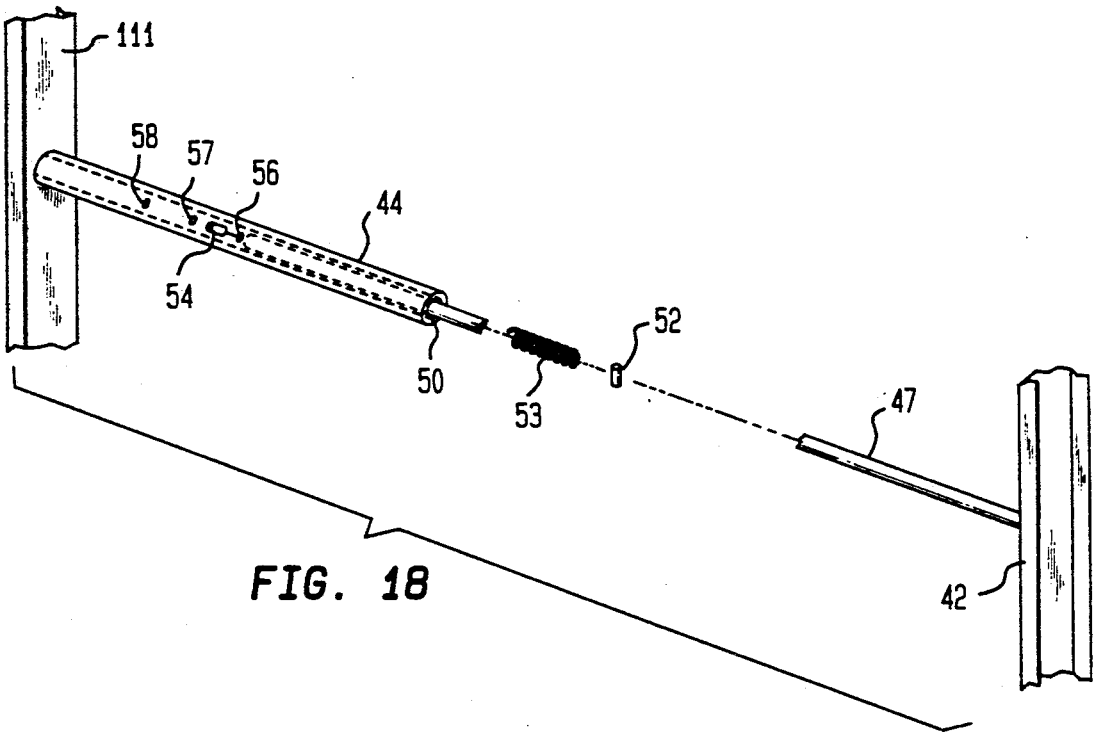
FIG. 18
FIG. 19
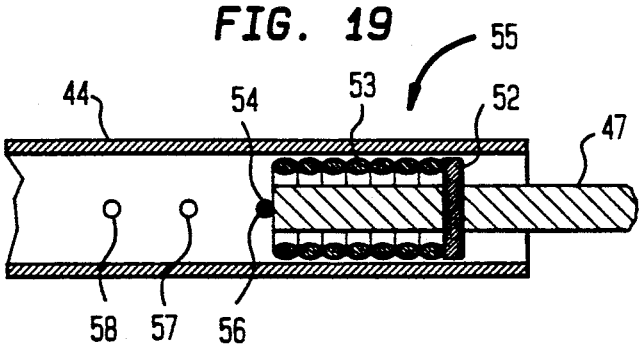

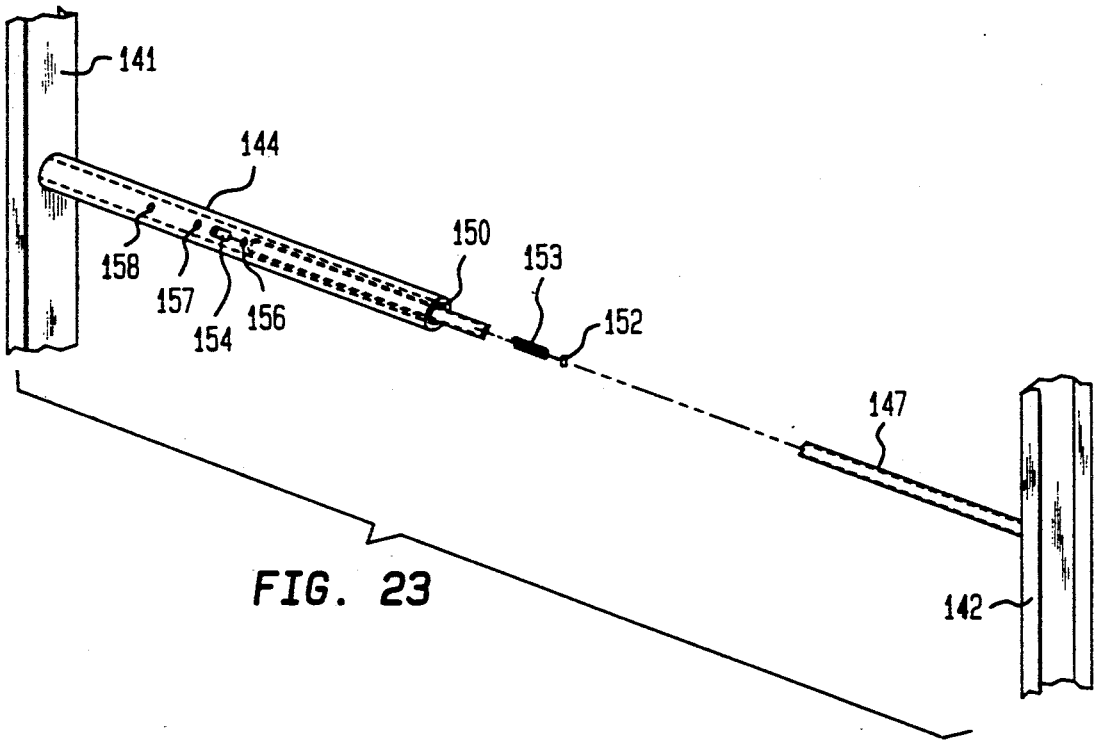
FIG. 23
FIG. 24
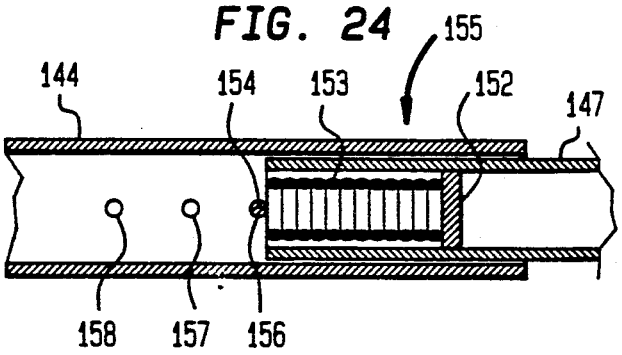

ADJUSTABLE GUARD ASSEMBLY WITH RESILIENT RELEASE MECHANISM

This invention relates generally to guard assemblies which are adjustable to block access through a framed window or other opening. More particularly, this invention relates to adjustable guard assemblies which include a resilient release mechanism which is designed to give way when sufficient force is applied during an emergency to permit free access through the framed window or other opening.

BACKGROUND OF THE INVENTION

The use of adjustable guard assemblies with a locking mechanism is generally disclosed in the prior art. This is shown in U.S. Pat. Nos. 4,685,247; 4,787,174; and 4,899,490.

In U.S. Pat. No. 4,899,490, a window guard assembly is disclosed having the well-known basic structure of a pair of sections slidably connected to each other to allow for varying the width of the guard assembly. The two sections include, vertical side members and vertical inner members which are interconnected by horizontally extending rods. The horizontally extending rods extend through spaced openings in the vertical inner members, thereby enabling the two sections to be adjusted relative to each other.

Further the drawings of U.S. Pat. No. 4,899,490 that this disclosed window guard assembly has a horizontally extending threaded member mounted on one section so as to extend through the vertical inner member of the other section and on which a wing nut is adjustably threaded with a locking washer for engagement with the vertical inner member of the other section so as to lock or fix the lateral movement of the respective sections relative to each other and thus adjust the width of the guard assembly to be sized for the space to be blocked by the guard.

In U.S. Pat. No. 4,685,247, a safety barrier positionable in a doorway or passageway is disclosed and at FIG. 4 shows a member having a threaded shank 24, a bush 38 and a turning knob 23.

A child safety gate is disclosed in U.S. Pat. No. 4,787,174, whereby the safety barrier comprises spring-biased panels which expand to securely engage a door frame.

U.S. Pat. Nos. 1,191,432 and 2,025,839, disclose manhole closures, each teaching the combination of a threaded rod, a spring and a nut for maintaining an attached member in a closed position.

The present invention discloses an improved adjustable guard assembly having, operatively associated sections longitudinally adjustable to vary the width of the adjustable guard assembly, and a resilient release mechanism adapted to fix the predetermined force at which the guard assembly can be pushed from its assembled position whenever such predetermined force setting is exceeded.

Thus the improved adjustable guard assembly with its resilient release mechanism in accordance with the present invention provides a device which is collapsible on the application of suitable pressure or force to allow the adjustable guard assembly to be forced out of a framed window or other enclosure if an emergency situation arises.

The present invention further improves upon the prior art, as it is constructed to comply with recently enacted statutes requiring that window guard assemblies be quickly removable if an emergency situation arises.

The present invention discloses an adjustable guard assembly which is sturdy enough to protect the safety of a young child while an adult can force the guard assembly into an opened position.

The present invention further discloses an improved adjustable guard assembly with a resilient release mechanism which is adjustable to give way only when the predetermined force to which the resilient release mechanism is set is exceeded.

SUMMARY AND OBJECTS OF THE INVENTION

The present invention pertains to an adjustable guard assembly which effectively blocks access through an enclosure in assembled position therein while at the same time remaining collapsible to allow for quick access through the enclosure if an emergency arises and includes, two sections which are interconnected for relative axial movement with respect to each other so as to vary and fix the width of the guard assembly to fit the enclosure, and a resilient release mechanism connected for operative engagement with at least one of the two sections is adjustable to set a predetermined pressure or force between the two sections at which the guard assembly can be collapsed for quick access through the enclosure.

In an adjustable guard assembly with a resilient release mechanism as described above, the two coacting sections are slidably mounted, whereby longitudinally extending members on one of the coacting sections extend through aligned apertures in supporting transverse members on the other coacting section to allow the width of the guard assembly to be adjusted to fit snugly into an enclosure such as a framed window, and the resilient release mechanism includes, a longitudinally extending threaded member connected on one of the coacting sections and disposed for engagement with a transverse member on the other coacting section, a nut or adjustable thumb screw threadably moveable along the threaded member, and a spring disposed between the nut and the associated transverse member on the other coacting section enables the nut to adjust the compressive forces exerted by the spring against the inner transverse member, until a tension is produced which corresponds with the desired predetermined force required to quickly remove the adjustable guard assembly if an emergency situation arises.

In a second embodiment of the present invention, an adjustable guard assembly with a resilient release mechanism as described above, again includes two sections which are slidably mounted whereby longitudinally extending members of each section are fixedly attached at one end to a vertical transverse member, and are aligned for operative association with hollow longitudinally extending members of the other section. The longitudinally extending members of a first section extend through aligned apertures in longitudinally extending members of the second section to allow the width of the guard assembly to be adjusted to fit snugly into an enclosure, such as a framed window, the resilient release mechanism includes a longitudinally extending threaded member of the first section disposed for operative aligned engagement with a hollow longitudinally extending member of the second section, an adjustable nut threadably moveable along the threaded member, a spring disposed on the threaded member between the nut and the aligned longitudinally extending member of a second section, and a spring retaining means disposed to prevent the spring from being forced into the longitudinally extending member of the second section, thereby enabling the nut to be adjusted until the compressive forces exerted by the spring against the retaining means of the longitudinally extending member of the second section produces a tension which corresponds with the desired predetermined force required to quickly remove the adjustable guard assembly under emergency conditions.

In a third embodiment of the present invention, an adjustable guard assembly with a resilient release mechanism as described above, includes two sections which are slidably connected, whereby generally hollow longitudinally extending members of a first section and a second section are fixedly attached at one end to respective vertical transverse members, and are aligned for operative engagement with the hollow longitudinally extending members of the other section to allow the width of the guard assembly to be adjusted to fit snugly into an enclosure such as a framed window. The resilient release mechanism includes at least one of the hollow longitudinally extending members on the first section disposed to extend into at least one of the aligned hollow longitudinally extending members of the second section, a fixed pin disposed on the longitudinally extending members of the first section, said fixed pin having a length substantially equivalent to the outer diameter of the hollow longitudinally extending members of the second section, a spring disposed on the longitudinally extending member of the first section retained at one end by the fixed pin and retained at the opposite end remote from the first end by a removable pin insertable through any of several pairs of spaced aligned apertures in the associated hollow longitudinally extending member of the second section, thereby enabling the compressive forces exerted by the spring against the removable pin to be adjusted to the desired predetermined force required to quickly remove the adjustable guard assembly in an emergency.

In a fourth embodiment of the present invention, an adjustable guard assembly with a resilient release mechanism as described above, includes two sections which are slidably mounted. The outside appearance of this fourth embodiment is identical to that of the third embodiment. The resilient release mechanism of this fourth embodiment is also similar as a spring is compressed between a fixed pin attached to a generally hollow longitudinally extending member of a first section and a removable pin which extends through one pair of aligned and spaced apertures in a hollow longitudinally extending member of the second section. However, in this fourth embodiment, the spring is disposed within the hollow portion of the longitudinally extending member of the first section and between a fixed pin that extends across the hollow longitudinally extending member of the first section and a removable pin in the associated hollow longitudinally extending member of the second section. As in the third embodiment, the removable pin is disposed to enable adjustment of the forces exerted by the spring against the removable pin until the desired predetermined force required to enable the adjustable guard assembly to be removed in an emergency situation is established.

Accordingly, it is an object of the present invention to provide an improved adjustable guard assembly which will allow for quick removability upon exertion of the required force against the adjustable guard assembly.

It is another object of the present invention to provide an improved adjustable guard assembly which can be manufactured at a relatively low cost.

It is another object of the present invention to provide in combination an adjustable guard assembly with a resilient release mechanism where the removability of the adjustable guard assembly after it is in assembled position will comply with all statutory requirements relating to removable window guard assemblies under conditions of an emergency.

It is still another object of the present invention to provide an improved adjustable guard assembly which will comply with statutory safety requirements while remaining cost effective.

These and other objects of the present invention will be more clearly understood when read in conjunction with the detailed description and accompanying drawings which follow.

DESCRIPTION OF THE DRAWINGS

FIG. 1 is a perspective view of a double hung window with one form of adjustable guard assembly positioned in the window frame in accordance with the present invention.

FIG. 2 is an enlarged front perspective view of the adjustable guard assembly shown in FIG. 1.

FIG. 18 is a partial exploded view showing the components of the resilient release mechanism in accordance with the form of the invention shown in FIGS. 15, 16 and 17.

FIG. 19 is an enlarged horizontal cross section taken at line 19—19 of FIG. 15.

FIG. 23 is a partial exploded view showing the components of the resilient release mechanism in accordance with the form of the invention shown in FIGS. 20, 21 and 22.

FIG. 24 is an enlarged horizontal cross section taken at line 24—24 of FIG. 20.

DETAILED DESCRIPTION

Figure 3:
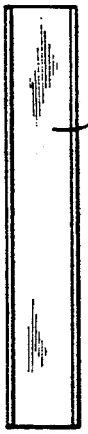
FIG. 3 is a left side view of the expandable guard assembly shown in FIGS. 1 and 2.

Referring to the drawings, FIGS. 1–7 show one preferred form of the adjustable guard assembly in accordance with the present invention generally designated 1 disposed to prevent access through the window frame of a double hung window generally designated DHW.

Adjustable guard assembly 1, includes a pair of sections 1A and 1B substantially identical with each other. The two sections include vertically disposed transverse outer member 2 and inner transverse member 4 on section 1A and transverse outer member 3 and inner transverse member 5 on section 1B. Each of the sections include generally horizontal longitudinally extending and spaced rods 6, 7 and 8 for section 1A and 9 and 10 for section 1B. Spaced rods 6, 7 and 8 are fixedly connected between the outer transverse member 2 and the inner transverse member 4 of section 1A by any suitable means and similarly spaced rods 9 and 10 are connected between the outer transverse member 3 and the inner transverse member 5 of section 1B.

In order to enable the adjustable guard assembly to be adjusted for enclosures having various widths, the respective spaced longitudinally extending rods are mounted to pass through sized and shaped apertures in the respective inner transverse member 4 and 5 of the associated coacting sections 1A or 1B. All of which is shown in FIGS. 1, 2, 4 and 5 of the drawings.

Figure 4:
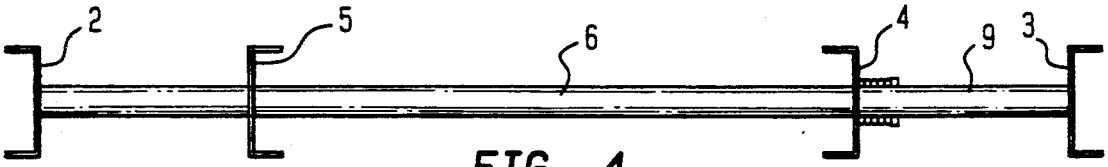
FIG. 4 is a top plan view of the adjustable guard assembly shown in FIGS. 1, 2 and 3.

Thus, FIGS. 2 and 4 show the inner transverse member 4 on section 1A has sized and spaced apertures as at 11 and 12 to permit spaced rods 9 and 10 of section 1B to be slidably disposed therein, and similarly inner transverse member 5 on section 1B has apertures as at 13, 14 and 15 to slidably receive the spaced rods 6, 7 and 8 of section 1A therethrough. Thus, sections 1A and 1B can be adjusted to the desired width by sliding the section 1A and 1B relative to each other until the desired width is reached.

As above described, locking mechanisms which have been used to fix the width of the adjustable guard assembly such as is shown in U.S. Pat. No. 4,899,490 and U.S. Pat. No. Re. 17911 have failed in emergency situations and therefor safety statutes and codes have been enacted to meet, overcome and prevent this dangerous condition from continuing.

The applicable safety statutes and codes which now or hereafter will apply for such adjustable guard assemblies, more particularly when such adjustable guard assemblies are used in multi-storied buildings, require or will require that the adjustable guard assemblies be so fixed that while it cannot be easily removed by a child to overcome the inherently dangerous situations which could occur if this happens nonetheless where an emergency arises it must be possible to overcome the forces which maintain the adjustable guard assembly in assembled position to permit egress or ingress through the opening being guarded by the adjustable guard assembly. The present invention as will now be described provides means for meeting these requirements of the safety statutes and codes for such adjustable guard assemblies.

Thus, the present invention provides a resilient release mechanism generally designated 15 which will serve the dual purpose of enabling the user of the adjustable guard assembly to fix the width so that the adjustable guard assembly will fit and block access through the space or window to be guarded and at the same time allow a predetermined force to be established which can be overcome so that the adjustable guard assembly can be pushed or pulled out of assembled position when an emergency makes it necessary to gain access through the space or window being guarded.

Figure 5:
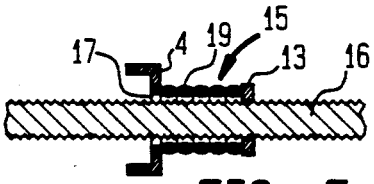
FIG. 5 is a enlarged horizontal cross section taken at line 5—5 of FIG. 2.
Figure 6:
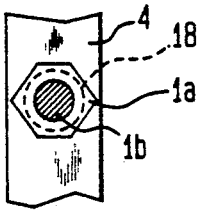
FIG. 6 is a vertical cross section taken at line 6—6 of FIG. 2.
Figure 7:
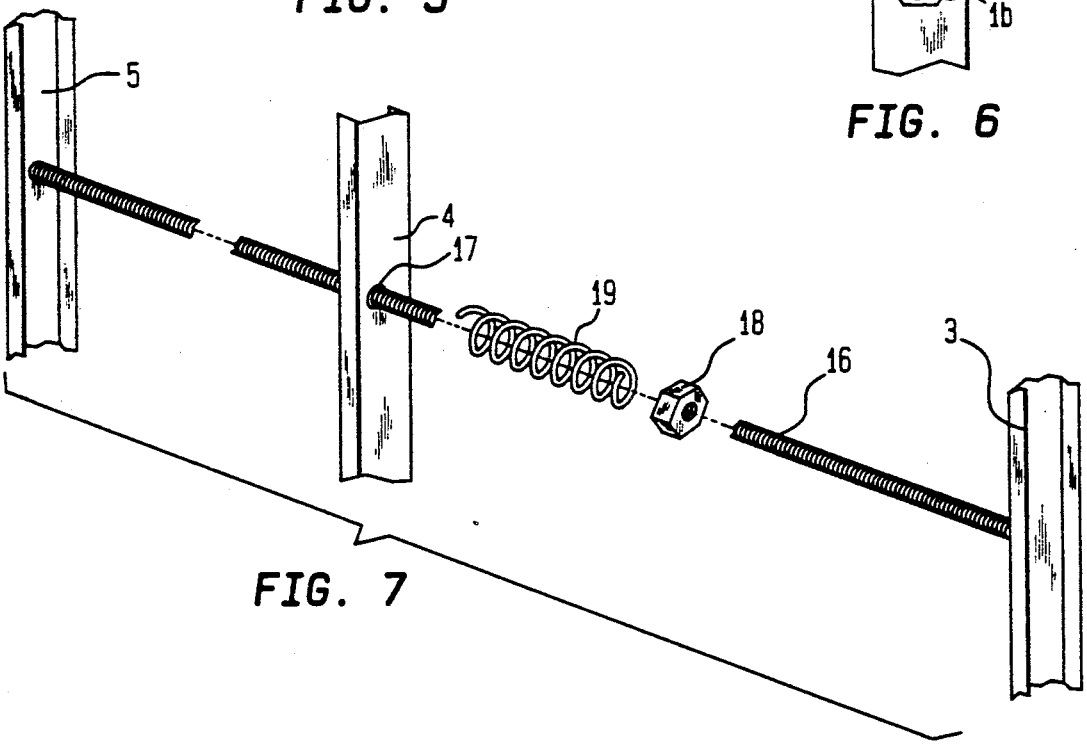
FIG. 7 is an exploded view showing the interrelation between the elements of the resilient release mechanism for the improved guard assembly as shown in FIG. 1.

FIGS. 5, 6 and 7 show that the resilient release mechanism 15 includes, longitudinally extending threaded rod 16 fixedly connected between outer transverse member 3 and inner transverse member 5 by any suitable means. Threaded rod 16 in assembled position is disposed so that it extends through an aperture 17 on the inner transverse member 4 of section 1A so the respective sections will always remain in slidable relation to enable the adjustable guard assembly 1 to be adjusted and fixed to the desired width for the access space being guarded.

In order to fix the adjustable guard assembly at the desired width, the resilient release mechanism 15 is provided with a nut 18 which can be threaded to and fro along the threaded rod 16, on the outboard side of the inner transverse member 4 of section 1A, and a resilient member or spring 19 which is mounted about the threaded rod 16 at a point thereon between the outboard face of the inner transverse member 4 and the adjustable nut 18.

Thus, when the adjustable nut 18 is threaded towards the inner transverse member 4, depending on the degree of compression exerted the spring or other resilient means 19 will exert a corresponding force, more or less, on the outboard side of the inner transverse member 4 to maintain the adjustable guard assembly in assembled position for the enclosure or space being guarded or protected and at the same time fix the force required in an emergency for an adult to quickly release the adjustable guard assembly 1 to permit free access through the space being guarded.

Those skilled in the art will readily recognize that the type and construction of the resilient or spring member 18 required for the desired operation will be a function of the force necessary to keep the adjustable guard assembly 1 in assembled position and the force that must be overcome to release the adjustable guard assembly in the event of an emergency. In this regard, a spring which will require a force of about forty to fifty pounds (40–50 lbs.) has been found adequate for this purpose.

OPERATION

The present invention provides an improved adjustable guard assembly 1, whereby a first section 1A and a second section 1B are interconnected for relative axial movement with respect to each other. The width of the adjustable guard assembly 1 can be varied to fit snugly within an enclosure such as a window frame. Resilient release mechanism 15, which is part of adjustable guard assembly 1, serves the dual purpose of enabling the user of the adjustable guard assembly 1 to fix and hold first section 1A and second section 1B in position, when the desired width has been obtained, so they are no longer free to slide with respect to each other, and at the same time allow an adult to exert a force sufficient to pull or push adjustable guard assembly 1 out of assembled position in the window frame or other enclosure being guarded if an emergency arises.

This second purpose, allowing for quick removability of the adjustable guard assembly 1 without the use of a key or tool, and without the use of excessive force, enables the present invention to meet the emergency egress standards of various state safety statutes.

A SECOND PREFERRED EMBODIMENT

FIGS. 8, 9, 10, 11 and 12 illustrate a second form of the present invention in which another type of adjustable guard assembly generally designated 20 is also intended to block access through an enclosure such as a framed window.

In this second form of the present invention, adjustable guard assembly 20, includes a pair of sections 20A and 20B disposed for operative association with each other. Section 20A includes vertically disposed transverse member 21 and a plurality of longitudinally extending hollow members 23, 24 and 25 each fixedly attached to transverse member 21 at a first end at a predetermined spaced distance from each other. Longitudinally extending hollow members 23, 24 and 25 include apertures 29, 30 and 31 respectively at a second end, remote from the first end, aligned for telescopic engagement with longitudinally extending rods of section 20B. Section 20B includes transverse member 22 and a plurality of longitudinally extending rods 26, 27 and 28 fixedly attached to transverse member 22 at a first end at a predetermined spaced distance from each other. Longitudinally extending rods 26, 27 and 28 remain disposed at a second end for telescopic engagement through apertures 29, 30 and 31 of longitudinally extending hollow members 23, 24 and 25 respectively.

Hollow longitudinally extending members 23, 24 and 25 of section 20A have a larger diameter than aligned longitudinally extending rods 26, 27 and 28 to enable rods 26, 27 and 28 to fit through apertures 29, 30 and 31 respectively thereby allowing the adjustable guard assembly 20 to be adjusted to fit enclosures of various widths. This is clearly shown in FIG. 8.

This second embodiment of the present invention provides a resilient release mechanism generally designated 35 which also serves the dual purpose of enabling the user of the adjustable guard assembly 20 to adjust the width of adjustable guard assembly 20 to fit the desired enclosure and therefore block access through the same enclosure and at the same time enable the user of adjustable guard assembly 20 to generate a predetermined force which can be overcome when the user pushes or pulls adjustable guard assembly 20 with enough pressure or force to remove the guard assembly from assembled position if an emergency makes it necessary to gain access through the enclosure being guarded.

Figure 8:
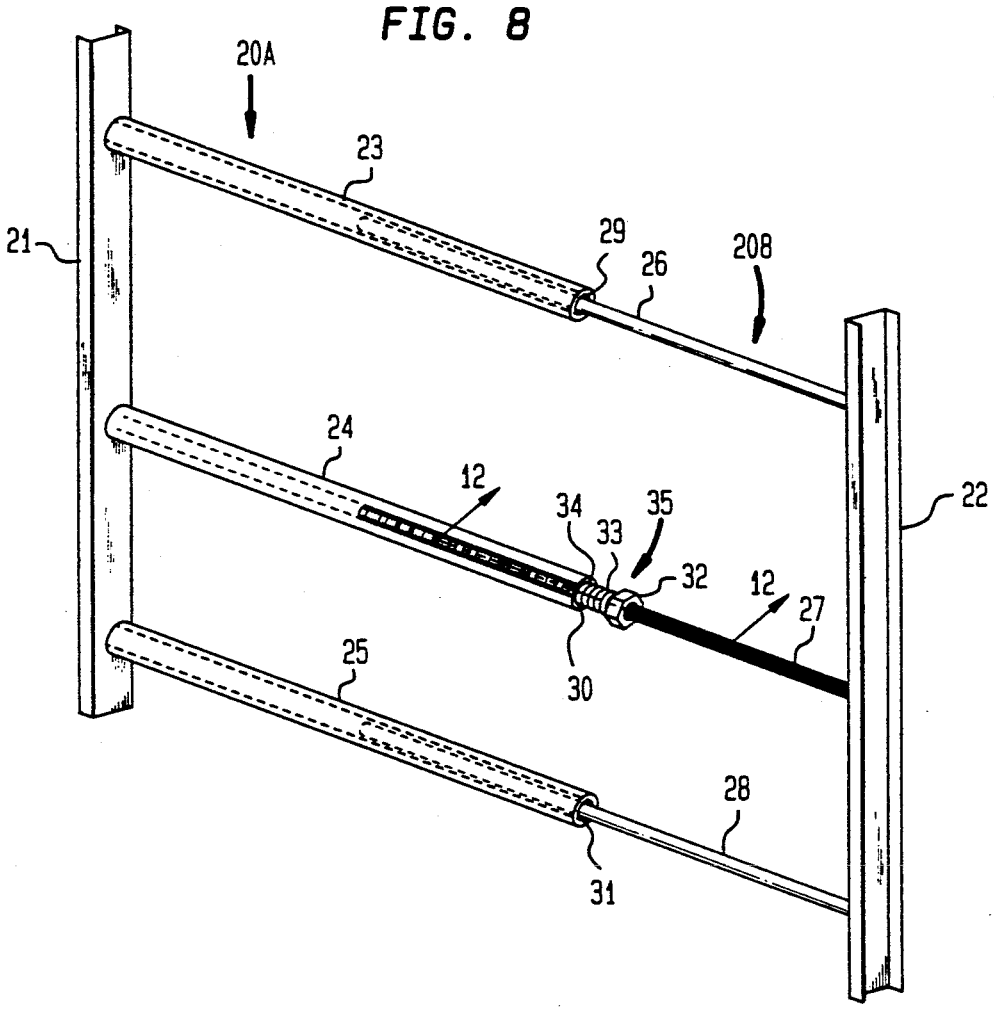
FIG. 8 is a front perspective view of second form of the adjustable guard assembly.
Figure 9:
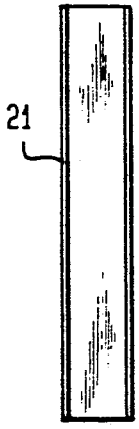
FIG. 9 is a left side view of the form of the adjustable guard assembly shown in FIG. 8.
Figure 10:
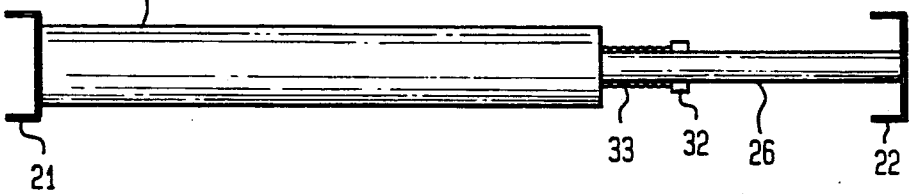
FIG. 10 is a top plan view of the form of the adjustable guard assembly shown in FIGS. 8 and 9.
Figure 11:
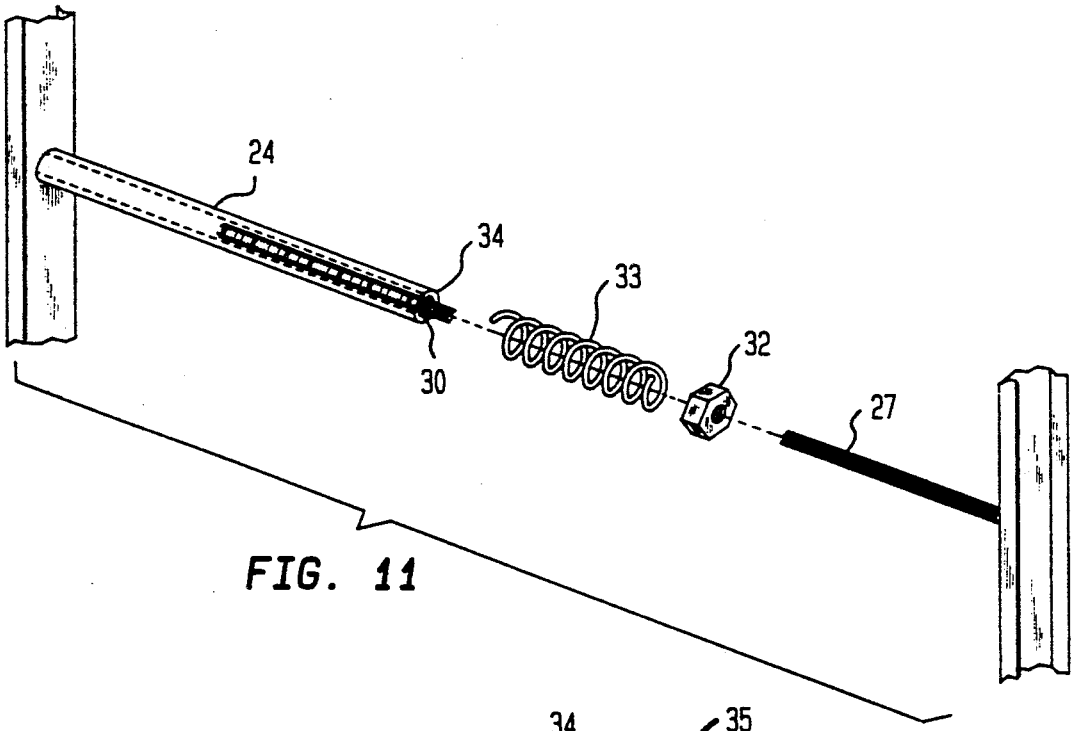
FIG. 11 is a partial exploded view showing the components of the resilient release mechanism in accordance with the form of the adjustable guard assembly shown in FIGS. 8, 9 and 10.
Figure 12:
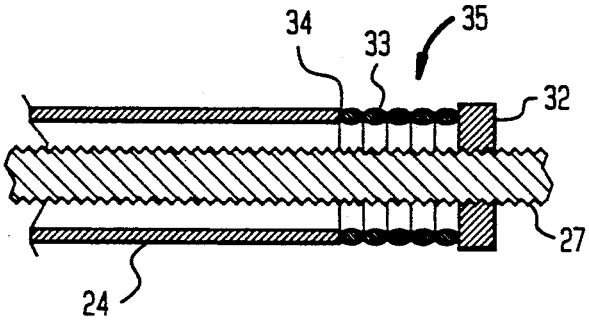
FIG. 12 is an enlarged horizontal cross section taken at line 12—12 of FIG. 8 showing a form of the spring retainer means.

FIGS. 8, 11 and 12 show that the resilient release mechanism 35 includes longitudinally extending threaded rod 27 fixedly connected at one end to transverse member 22 of section 20B by any suitable means. At the other end of threaded rod 27 remote from the fixedly attached end, threaded rod 27 is disposed so that it extends through aperture 30 in alignment with longitudinally extending member 24 of section 20A so that the respective sections will remain in slidable relation to enable adjustable guard assembly 20 to be adjusted to the desired width for the enclosure being blocked.

As in the first embodiment, in order to fix the adjustable guard assembly at the desired width, the resilient release mechanism 35 includes a nut 32 which can be threaded along threaded rod 27 of section 20B, and a resilient member or spring 33 which is positioned on threaded rod 27 between nut 32 and a retainer designated 34 on the associated end of longitudinally extending member 24 thereby preventing spring 33 from being forced through aperture 30 on longitudinally extending member 24. Thus, when the nut 32 is threaded toward longitudinally extending member 24, spring 33 is compressed accordingly thereby increasing the force, more or less, exerted between the window frame and transverse members 21 and 22 so the adjustable guard assembly 20 will be maintained in assembled position within the window frame and at the same time can be quickly removed upon the application of the force required in an emergency for an adult to quickly release the adjustable guard assembly from the enclosure to permit access therethrough.

Figure 13:
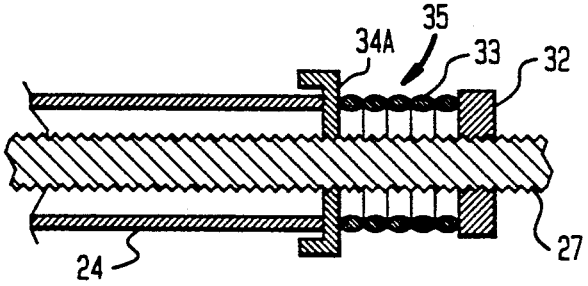
FIG. 13 is an enlarged horizontal cross section showing a second form of the spring retainer means shown in cross section in FIG. 12.
Figure 14:
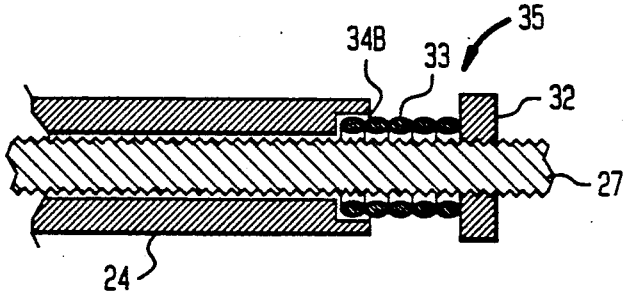
FIG. 14 is an enlarged horizontal cross section showing a third form of the spring retainer means shown in cross section in FIG. 12.

As illustrated in FIGS. 13 and 14, the spring retainer designated as 34A in FIG. 13 and 34B in FIG. 14, can be varied by size, shape and appearance and still perform the same function of restraining spring 33 from being forced through aperture 30 and thereby enabling the resilient release mechanism to maintain the force required before the adjustable guard assembly 20 can be removed during an emergency from the enclosure or space being guarded.

Those skilled in the art will recognize that the spring retainer can be altered in many other ways and still serve its desired function.

A THIRD EMBODIMENT

FIGS. 15, 16, 17, 18 and 19 illustrate a third form of the present invention in which another type of adjustable guard assembly generally designated 40, similar in structure to the guard assembly shown in the second form of the invention, is also intended to block access through an enclosure and permit quick removal of the guard assembly in emergency situations.

This form of the invention differs from the form of the invention shown in FIGS. 8 through 11 in that the resilient release mechanism is not visible from the outward appearance of the guard assembly. As in the second embodiment of the present invention, this third embodiment includes two sections designated 40A and 40B which are slidably engaged.

In this third embodiment, section 40A includes a plurality of aligned longitudinally extending hollow members 43, 44 and 45 of a predetermined diameter which are fixedly attached at a first end to transverse member 41. The longitudinally extending hollow members include apertures 49, 50 and 51 respectively at a second end remote from the fixedly attached end. Section 40B includes aligned longitudinally extending rods 46, 47 and 48, fixedly attached at one end to transverse member 42, and disposed at the other end for slidable engagement with section 40A through apertures 49, 50 and 51 of longitudinal members 43, 44 and 45 respectively as illustrated in FIG. 15.

Resilient release mechanism generally designated 55 will also serve the dual purpose of enabling the user of the adjustable guard assembly 40 to fix the width so that the adjustable guard assembly can block access through an enclosure and at the same time be adjusted so that only a predetermined force then can be exerted by an adult in an emergency situation will serve to quickly remove the adjustable guard assembly 40 from the enclosure thereby allowing access through the space which was blocked.

Figure 15:
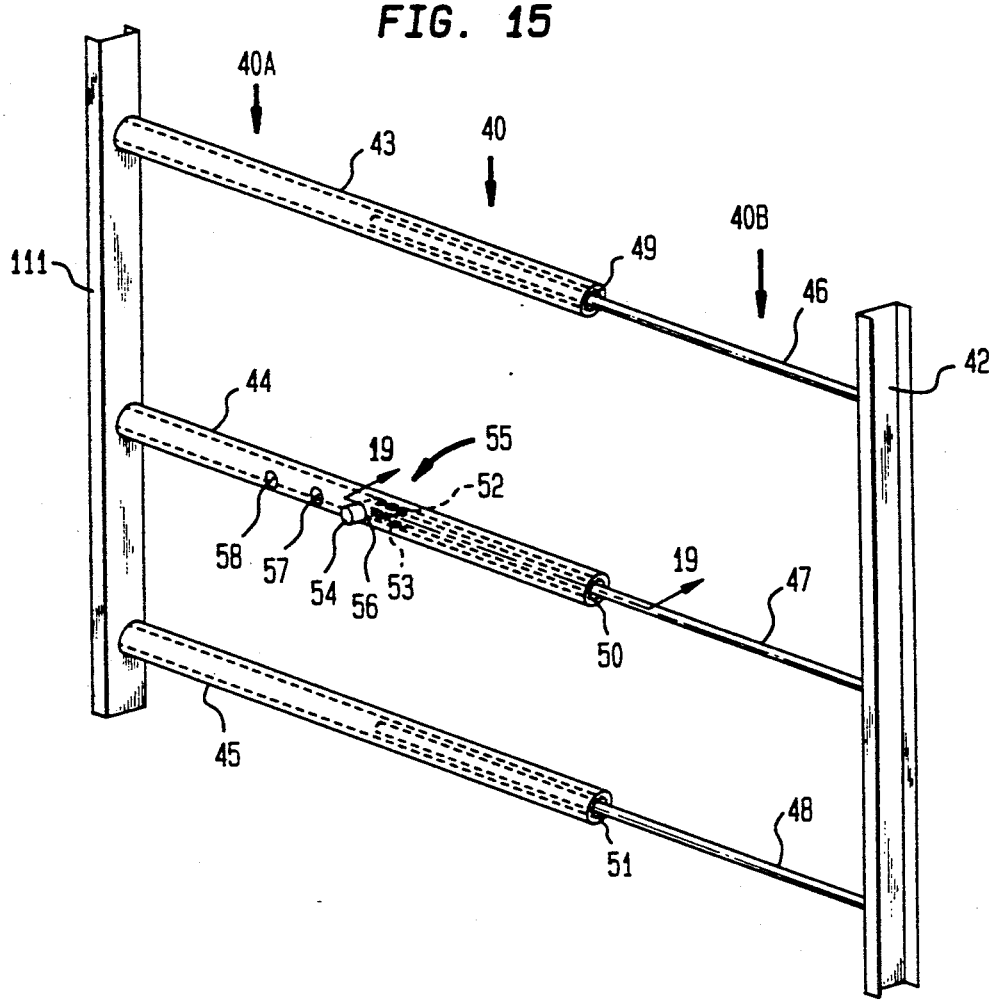
FIG. 15 is a front perspective view of a third form of an adjustable guard assembly.
Figure 16:
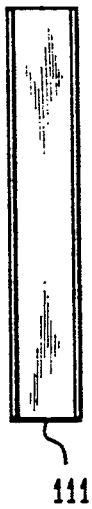
FIG. 16 is a left side view of the form of the invention shown in FIG. 15.
Figure 17:
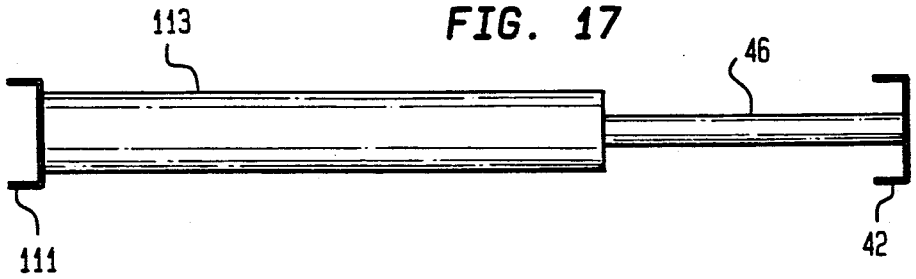
FIG. 17 is a top plan view of the form of the invention shown in FIGS. 15 and 16.

FIGS. 15, 18 and 19 show that resilient release mechanism 55 includes longitudinally extending hollow member 44 of section 40A fixedly connected by any suitable means to transverse member 41 at a first end and having sized and shaped aperture 50 disposed at a second end. Longitudinally extending rod member 47 of section 40B is similarly fixedly attached to transverse member 42 at a first end and is aligned for slidable engagement through said aperture 50 at the second end remote, from the fixedly attached first end of transverse member 41 to allow the respective sections to remain in slidable relation thereby enabling adjustable guard assembly 40 to be adjusted to the desired width to block access through the enclosure.

As shown in FIGS. 18 and 19, resilient release mechanism 55 also includes fixed pin 52 which extends through a portion of longitudinally extending rod 47 to a length approximately equivalent to the diameter of the hollowed out portion of longitudinally extending member 44 thereby abutting spring 53 at one end. Spring 53 has an inner diameter slightly larger than the outer diameter of rod 47 so as to be disposed on rod 47. Hollow longitudinally extending member 44 includes a series of spaced and paired apertures as at 56, 57 and 58 which allow for insertion and removal of an adjustable pin 54. Thus, spring 53 is disposed on longitudinally extending rod 47 between fixed pin 52 and adjustable pin 54. Adjustable pin 54 can be placed through any one of the aligned, paired and spaced apertures 56, 57 and 58 in longitudinally extending member 44 as shown in FIG. 15, thereby allowing the spring 53 to be compressed more or less as may be required to set the predetermined force required for maintaining the adjustable guard assembly in assembled position in the space or window being guarded and still permit the forces so exerted to be quickly and easily overcome by an adult when necessary during an emergency.

As can be gleaned from FIGS. 15, 18 and 19, when adjustable pin 54 is moved further away from or closer to the fixed pin 52, the compression forces exerted by spring 53 will be decreased and increased accordingly, and the corresponding force for maintaining the adjustable guard assembly between the side walls of the space or window being guarded will be proportionally decreased or increased. Therefore, by adjusting the location of removable pin 54, an adult can fix the predetermined force required in an emergency to quickly release adjustable guard assembly 40 and permit free access through the space or window being guarded.

A FOURTH EMBODIMENT

FIGS. 20, 21, 22, 23 and 24 illustrate a fourth form of the adjustable guard assembly generally designated 140.

This fourth embodiment is substantially similar to the third embodiment. As in the third embodiment, the resilient release mechanism generally designated 155 is not visible when adjustable guard assembly 140 is in assembled position.

Figure 20:
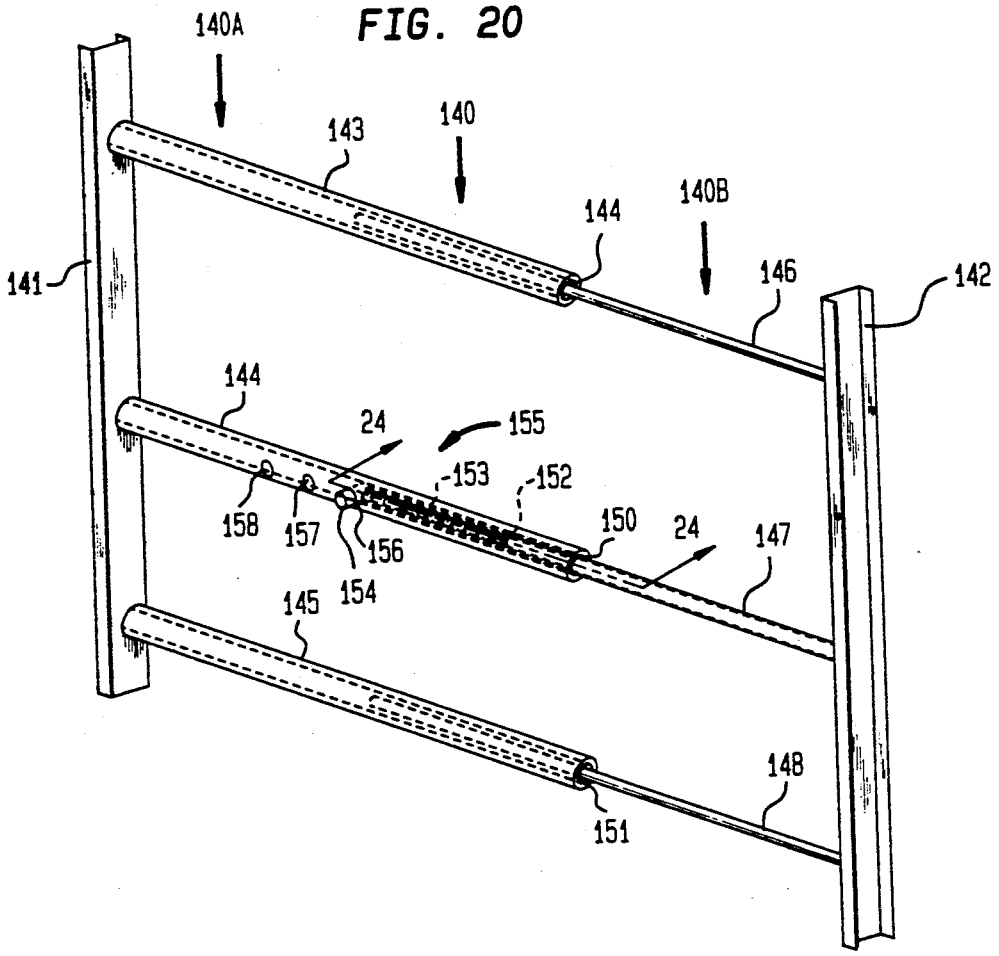
FIG. 20 is a front perspective view of a fourth form of the present invention.
Figure 21:
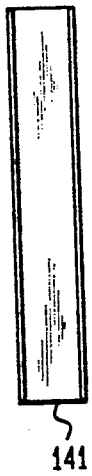
FIG. 21 is a left side view of the form of the invention shown in FIG. 20.
Figure 22:
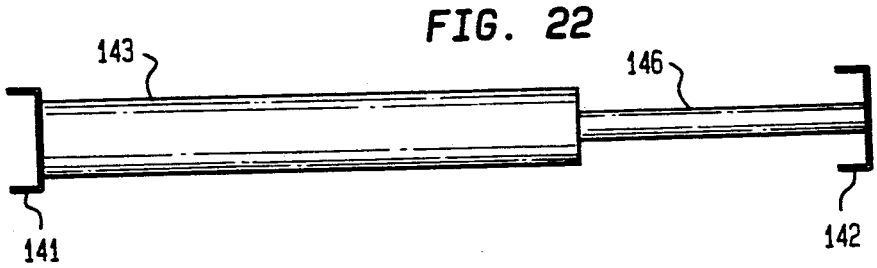
FIG. 22 is a top plan view of the form of the invention shown in FIGS. 20 and 21.

This fourth form of the present invention differs from the third embodiment shown in FIGS. 15 through 18, in that the longitudinally extending members 146, 147 and 148 of section 140B are not solid rods, but are hollow tubes in which spring 153 is inserted. Another difference from the third embodiment is that fixed pin 152 is inserted through hollow longitudinally extending member 147 to act as a stop for spring 153 inside hollow tube 147, all of which is shown in FIGS. 20, 23 and 24. This stop is therefor different from the stop formed on the longitudinally extending solid rod of the form of the invention shown in FIGS. 15 to 19, but operates to achieve the same result.

In all other respects, the fourth embodiment of the adjustable guard assembly is substantially identical to and operates in the same manner as the third embodiment of the adjustable guard assembly.

Thus, as depicted in FIGS. 1 through 7, 8 through 14, 15 through 19, and 20 through 24 and described herein, an improved adjustable guard assembly with a resilient release mechanism is shown which can be easily removed from a window frame without the use of a key or a tool or excessive force, thereby enabling the present invention to meet the emergency egress standards of various state safety statues.

While the foregoing description illustrates various preferred embodiments of the apparatus in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. Adjustable guard assembly means for blocking access through an enclosure, comprising:

a. a first section means and second section means disposed in slidable relation to each other, each of said first section means and second section means including, at least one transverse member, and a plurality of longitudinally extending members each having a first end and a second end remote from said first end, and said first end of said plurality of longitudinally extending members connected to at least one transverse member of the associated first section means and second section means, b. interconnecting means for said plurality of longitudinally extending members on said first section means and said second section means to permit relative longitudinal movement of said first section means and said section means with respect to each other, c. a resilient release means operatively associated with said first section means and said second section means adjustable to create a predetermined force for maintaining said first section means said second section means in desired longitudinal relation to each other and to permit quick removal of said adjustable guard assembly means from its assembled position within an enclosure, d. said plurality of longitudinally extending members of said second section means includes, at least one longitudinally extending threaded member having, a first end, and a second end, and said first end connected to the at least one transverse member of said second section, and e. said resilient release means includes said at least one longitudinally extending threaded member, nut means disposed for threaded movement along said longitudinally extending threaded member, retaining means for operative association with said longitudinally extending threaded member, and a resilient member disposed for compressible association between said nut means and said retaining means.

2. In the adjustable guard assembly means as claimed in claim 1, whereby said retaining means is disposed on said first section for abutment with said resilient means.

3. In the adjustable guard assembly means as claimed in claim 2, whereby said longitudinally extending threaded member, said nut means, said retaining means, and said resilient means are operatively associated to allow for adjustment of a predetermined force for maintaining said first section means and said second section means in the desired relative longitudinal position and to permit quick removal of said adjustable guard assembly means from its assembled position within an enclosure.

4. Adjustable guard assembly means for blocking access through an enclosure, comprising:

a. first section means and second section means disposed in slidable relation to each other, each of said first section means and second section means including, an outer transverse member and an inner transverse member, a plurality of longitudinally extending members each having a first end connected to said outer transverse member and a second end remote from said first end connected to said inner transverse member, b. interconnecting means disposed on said first section means and said second section means to permit relative longitudinal movement of said first section means and said second section means with respect to each other, c. resilient release means operatively associated with said first section means and said section means adjustable to create a predetermined force for maintaining said first section means and said second section means in desired longitudinal relation to each other and to enable quick removal of said adjustable guard assembly means from its assembled position within the enclosure by overcoming said predetermined force, d. said plurality of longitudinally extending members of said second section means include at least one longitudinally extending threaded member having a first end connected to said outer transverse member and a second end remote from said first end connected to said inner transverse member, e. said interconnecting means includes, a plurality of sized and shaped apertures disposed on each of said inner transverse members of said first section means and said second section means, each of said plurality of said sized and shaped apertures aligned with one of the plurality of longitudinally extending members of said first section means and said second section means, thereby permitting each of said plurality of longitudinally extending members to extend through the corresponding aligned sized and shaped aperture on the associated inner transverse member of the respective slidably associated first section means and second section means, and f. said resilient release means includes, said at least one longitudinally extending threaded member on said second section means, nut means disposed for threaded movement along said at least one longitudinally extending threaded member, retaining means for operative connection with said at least one longitudinally extending threaded member, and a resilient means disposed to be compressed between said nut means and said retaining means.

5. In the adjustable guard assembly means as claimed in claim 4, wherein said retaining means is the portion of the inner transverse member surrounding said sized and shaped aperture through which said longitudinally extending threaded member extends, said retaining means disposed to face said outer transverse member of said second section means.

6. In the adjustable guard assembly means as claimed in claim 5, wherein said resilient means is a spring.

7. In the adjustable guard assembly means as claimed in claim 6 whereby, the components of said resilient release means are operatively associated to allow for adjustment of the force for maintaining said first section means and said second section means in the desired relative longitudinal position and to permit quick removal of said adjustable guard assembly means from its assembled position within an enclosure when said force is overcome.

8. Adjustable guard assembly means for blocking access through an enclosure, comprising:

a. first section means and second section means disposed in slidable relation to each other, each of said first section means and second section means including a transverse member and a plurality of longitudinally extending members each having a first end and a second end, said plurality of longitudinally extending members connected at said first end to an associated transverse member and disposed for slidable engagement at said second end with an aligned longitudinally extending member of the other section, b. a connecting means disposed on said first section means and said second section means to permit relative longitudinal movement of said first section means and said second section means with repect to each other, c. resilient release means operatively associated with said first section means and said second section means for creating a predetermined force and adjusting said predetermined force to maintain said first section means and said second section means in desired longitudinal relation to each other and to permit quick removal of said adjustable guard assembly means from its assembled position within the enclosure when said force is overcome, d. said plurality of longitudinally extending members of said first section means are hollow and each have a larger inner diameter than the outer diameter of each of said plurality of longitudinally extending members of said second section means, e. said plurality of longitudinally extending members of said second section means includes at least one longitudinally extending threaded member having a first end and a second end remote from said first end, said at least one longitudinally extending threaded member connected at said first end to said associated transverse member and disposed for slidable engagement at said second end with an aligned longitudinally extending hollow member of said first section means, f. said connecting means includes, a plurality of sized and shaped apertures formed in said second end of said longitudinally extending hollow members of said first section means remote from the first end connected to the associated transverse member, and g. said resilient release means includes, said at least one longitudinally extending threaded member on said second section means, nut means disposed for threaded movement along said at least one longitudinally extending threaded member, retaining means disposed for operative relation with said at least one longitudinally extending threaded member, and a resilient means disposed for compressible association between said nut means and said retaining means.

9. In the adjustable guard assembly means as claimed in claim 8, wherein said retaining means is disposed around said sized and shaped apertures of said second end of said plurality of longitudinally extending hollow members of said first section means.

10. In the adjustable guard assembly means as claimed in claim 9, wherein said resilient means is a spring.

11. In the adjustable guard assembly means as claimed in claim 10, whereby the components of said resilient release means are operatively associated to allow for adjustment of said force for maintaining said first section means and said second section means in the desired longitudinal position and to permit quick removal of said adjustable guard assembly means from its assembled position within an enclosure when said adjusted force is overcome.

12. Adjustable guard assembly means for blocking access to an enclosure, comprising:

a. first section means and second section means disposed in slidable relation to each other, each of said first section means and second section means including, a transverse member and a plurality of longitudinally extending members each having a first end and a second end remote from said first end, said longitudinally extending members connected at said first end to an associated transverse member, b. said plurality of longitudinally extending members on said first section means are hollow and have a larger diameter than said plurality of longitudinally extending members on said second section means, c. said plurality of longitudinally extending hollow members of said first section means are aligned for interconnecting slidable engagement with said plurality of longitudinally extending members of said second section means, d. resilient release means operatively associated with said first section means and said second section means, including adjustable means to set a predetermined force for maintaining said first section means and said second section means in desired longitudinal relation to each other and to permit quick removal of said adjustable guard assembly means from its assembled position within an enclosure when said predetermined force is overcome, e. said adjustable means including:

i. at least one of said longitudinally extending hollow member on said first section having at least two spaced pairs of aligned apertures therethrough, and a removable pin means disposed for insertion and removal from any pair of said spaced and aligned apertures, ii. at least one of said longitudinally extending member on said second section having a fixed pin means inserted transversely therethrough, aligned for slidable association with said at least one longitudinally extending hollow member of said first section, having said removable pin means therein, and iii. resilient means disposed for compressible association between said removable pin means and said fixed pin means.

13. In the adjustable guard assembly means as claimed in claim 12, whereby said resilient means is a spring.

14. In the adjustable guard assembly means as claimed in claim 12, wherein said plurality of longitudinal extending members of said second section means are solid.

15. In the adjustable guard assembly means as claimed in claim 14, wherein said fixed pin means has a total length substantially equivalent to the diameter of the associated longitudinally extending hollow member of said first section means.

16. In the adjustable guard assembly means as claimed in claim 12 wherein, said plurality of longitudinally extending members of said second section are hollow.

17. In the adjustable guard assembly means as claimed in claim 16 wherein, said fixed pin means extends across the entire diameter of the associated hollow longitudinally extending member of said second section.

* * * * *

UNITED STATES PATENT AND TRADEMARK OFFICE

CERTIFICATE OF CORRECTION

PATENT NO. : 5,070,647

DATED : December 10, 1991

INVENTOR(S) : Millard L. Spialter

It is certified that error appears in the above-identified patent and that said Letters Patent is hereby corrected as shown below:

In the Abstract, lines 5-6, "respectively" should read --respective--.
Column 4, line 42, after "of" (first occurrence) insert --a--.
Column 9, line 53, after "assembly" insert --40--.
Column 10, line 51, after "said" insert --second--.
Column 11, line 37, after "said" (second occurrence) insert --second--.

Signed and Sealed this

Twentieth Day of April, 1993

*Attest:*

MICHAEL K. KIRK

*Attesting Officer*

*Acting Commissioner of Patents and Trademarks*